US006113409A

United States Patent [19]

Park

[11] Patent Number: 6,113,409

[45] Date of Patent: Sep. 5, 2000

[54] CONNECTING APPARATUS FOR CARTRIDGE OF LEARNING DEVICE

[75] Inventor: Kwang-sig Park, Seoul, Rep. of Korea

[73] Assignee: SamSung Electronics Co., Ltd., Suwon, Rep. of Korea

[21] Appl. No.: 09/166,231

[22] Filed: Oct. 5, 1998

[51] Int. Cl.[7] ..... H01R 13/62

[52] U.S. Cl. ..... 439/310; 439/326; 439/136; 439/945; 439/157; 439/929

[58] Field of Search ..... 439/325, 326, 439/327, 330, 331, 136, 945, 946, 310, 157, 372, 929

[56] References Cited

U.S. PATENT DOCUMENTS

| | | | |
|---|---|---|---|
| 4,763,300 | 8/1988 | Yukawa | 365/52 |
| 5,253,139 | 10/1993 | Satou | 361/681 |
| 5,401,179 | 3/1995 | Shinchi et al. | 439/157 |
| 5,669,781 | 9/1997 | Ishida | 439/326 |
| 5,679,013 | 10/1997 | Matsumaga et al. | 439/144 |
| 5,885,095 | 3/1999 | Cohen et al. | 439/138 |

*Primary Examiner*—Paula Bradley
*Assistant Examiner*—Truc Nguyen
*Attorney, Agent, or Firm*—Robert E. Bushnell, Esq.

[57] ABSTRACT

Enclosed is a connecting apparatus for a cartridge of a learning device for connecting a cartridge having software to a main body of the learning device. When a user only rotates the cartridge to a supporting frame direction in such a condition that the cartridge is inserted, a connector supporting holder having the connector moves to an upper direction. Accordingly, a printed circuit board of the cartridge connects to the connector exactly. Consequently, the connecting failure between the cartridge and the connector can be prevented and the inserting and withdrawing operation of the cartridge are easily executed because the inserting and withdrawing operation of the cartridge are executed before and behind the connecting operation of the connector.

15 Claims, 7 Drawing Sheets

CONNECTING APPARATUS FOR CARTRIDGE OF LEARNING DEVICE

BACKGROUND OF THE INVENTION

1. Field of the Invention

The present invention relates to a connecting apparatus for a cartridge of a learning device for a toddler, and more particularly, relates to a connecting apparatus for a cartridge of a learning device, which cartridge having software connects to a main body of a learning device exactly and connecting and withdrawing operations of a cartridge to and from a main body is easily executed.

2. Background of the Related Art

Generally, a learning device for a toddler can change a cartridge easily by detachably forming the cartridge having software to a main body of a learning device.

There is a cartridge inserting space for installing the cartridge into the main body and a connector for connecting to a printed circuit board in an inner portion.

Nevertheless, an opening for inserting the cartridge is larger than a cartridge inserting groove in the connecting apparatus for the cartridge according to a prior art. Accordingly, when the cartridge is inserted into the cartridge inserting groove, the cartridge is exactly inserted into the connecting position of the cartridge and a connector.

Moreover, for exactly connecting the cartridge, a user presses the cartridge as much as he can because a printed circuit board of the cartridge is directly connected to the connector at a time.

When the cartridge is inexactly inserted or the inserting power of the cartridge is poor, the problems that the connecting failure between the printed circuit board of the cartridge and the connector and the breakage of the printed circuit board or the connector at the worst can be caused.

SUMMARY OF THE INVENTION

Therefore, it is an object of the present invention to provide a connecting apparatus for a cartridge, which connects a cartridge having software to a main body of a learning device exactly.

It is another object of the present invention to provide a connecting apparatus for a cartridge, which connecting operation of a cartridge having software to a main body of a learning device is easily executed.

For achieving the above-mentioned object, the connecting apparatus for the cartridge of the learning device, which connects the cartridge equipping with a printed circuit board having recorded information to the main body of the learning device for re-outputting the information in the printed circuit board to an output device, includes: a supporting frame installed on the main body for supporting the rear face of the cartridge; a subsidiary frame installed on a lower portion of the supporting frame and having an inserting groove for inserting the cartridge formed at an upper portion; a cartridge holder for holding the cartridge in the inner portion of the subsidiary frame and a connector supporting holder for connecting or disconnecting the connector to or from the printed circuit board of the cartridge by ascending and descending in the inner portion of the cartridge holder according to the rotation of the cartridge, wherein the connector supporting holder equips with the connector in the inner portion and movably connected to the lower portion of the cartridge holder. It is preferred that a torsion spring for elastically supporting the cartridge holder to a withdrawing direction of the cartridge at the rotating center of the cartridge holder is fixed to a rotating shaft formed at the side face of the cartridge holder.

It is still preferred that one terminal of the torsion spring is fixed to the inner side of the subsidiary frame and another terminal of the torsion spring is regulated by a stopper formed at the side of the cartridge holder.

Preferably, a rib contacting unit is installed on one lower side portion of the connector supporting holder and a guide rib is formed in the upper case, wherein the guide rib guides the rib contacting unit when the cartridge rotates so that the connector supporting holder ascends and descends in the cartridge holder.

Moreover, it is preferred to install a coil spring on a guide shaft that coil spring elastically supports the connector supporting holder to move to a downward direction of the cartridge holder at both sides of the connector supporting holder.

Moreover, preferably, a locking knob for detachably combining the upper end portion of the cartridge and a torsion spring for elastically supporting the locking knob to an outside direction are installed on the upper end portion of the main body.

Accordingly, the connecting apparatus for the cartridge according to the present invention can exactly connect the cartridge to the main body and easily insert and withdraw the cartridge into and from the main body.

BRIEF DESCRIPTION OF THE DRAWINGS

A more complete appreciation of the present invention, and may of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The preferred embodiment according to the present invention will be described hereinafter while referring to attached FIGS.

In the following description, when detailed description related to disclosed function and structure is unnecessarily obvious to the substance of the present invention, the detailed description will be emitted.

Figure 1:
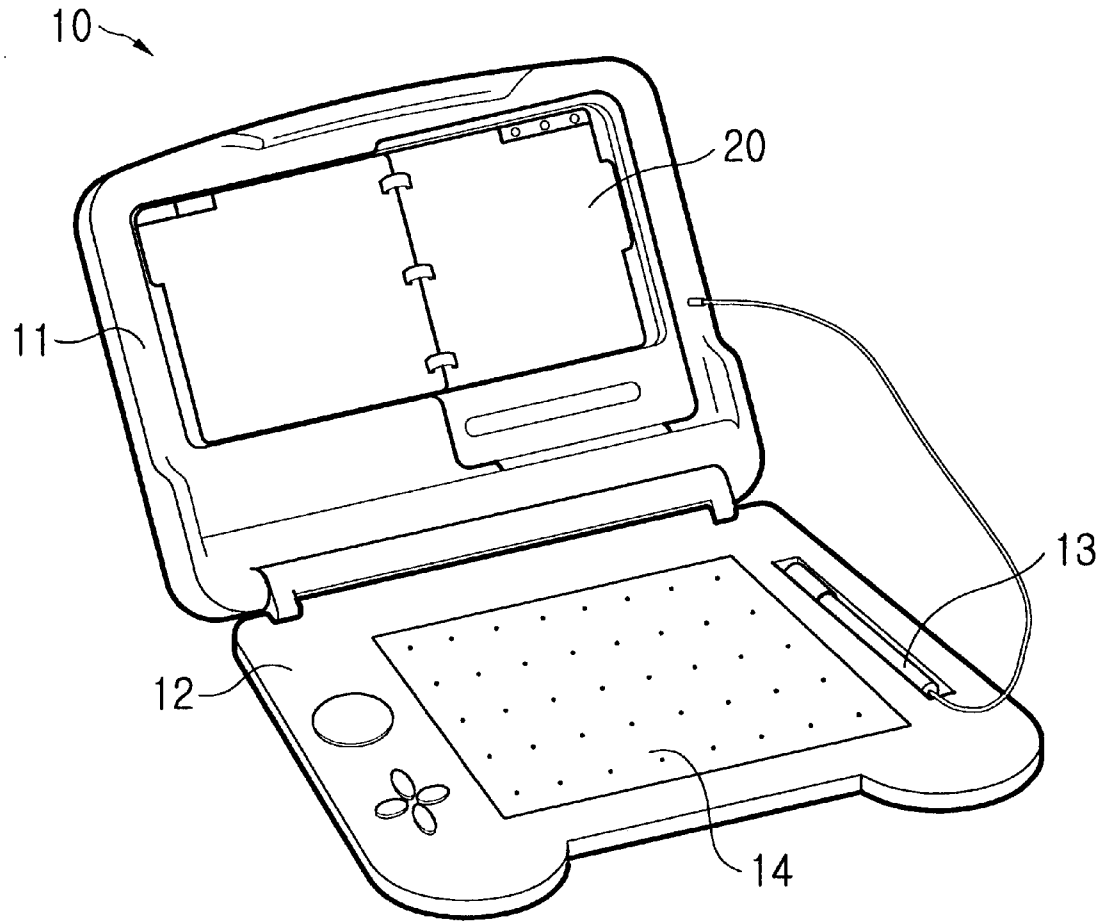
FIG. 1 is a perspective view illustrating inserted condition of a cartridge into a learning device according to a preferred embodiment of the present invention.

As shown in FIG. 1, a main body 10 of the learning device is divided into an upper case, or cover and a lower case, or base 12 and the upper case 11 is detachably combined with the lower case 12 according to the present invention.

The upper case 11 has a control unit for controlling overall operation of the learning device system and a voice, or audio output and an image, or audio output output terminals for respectively outputting an audio and a video signal to a display unit such as a monitor.

The lower case 12 equips with electronic pen 13 for selecting a predetermined position of the cartridge 20 of the software for talkatively operating the learning device or for selecting a predetermined position of the image displayed in the display unit and a tablet 14 for transporting the current position of electronic pen 13 to the control unit by recognizing the moving signal of electronic pen 13 when a user moves electronic pen 13.

Figure 2:
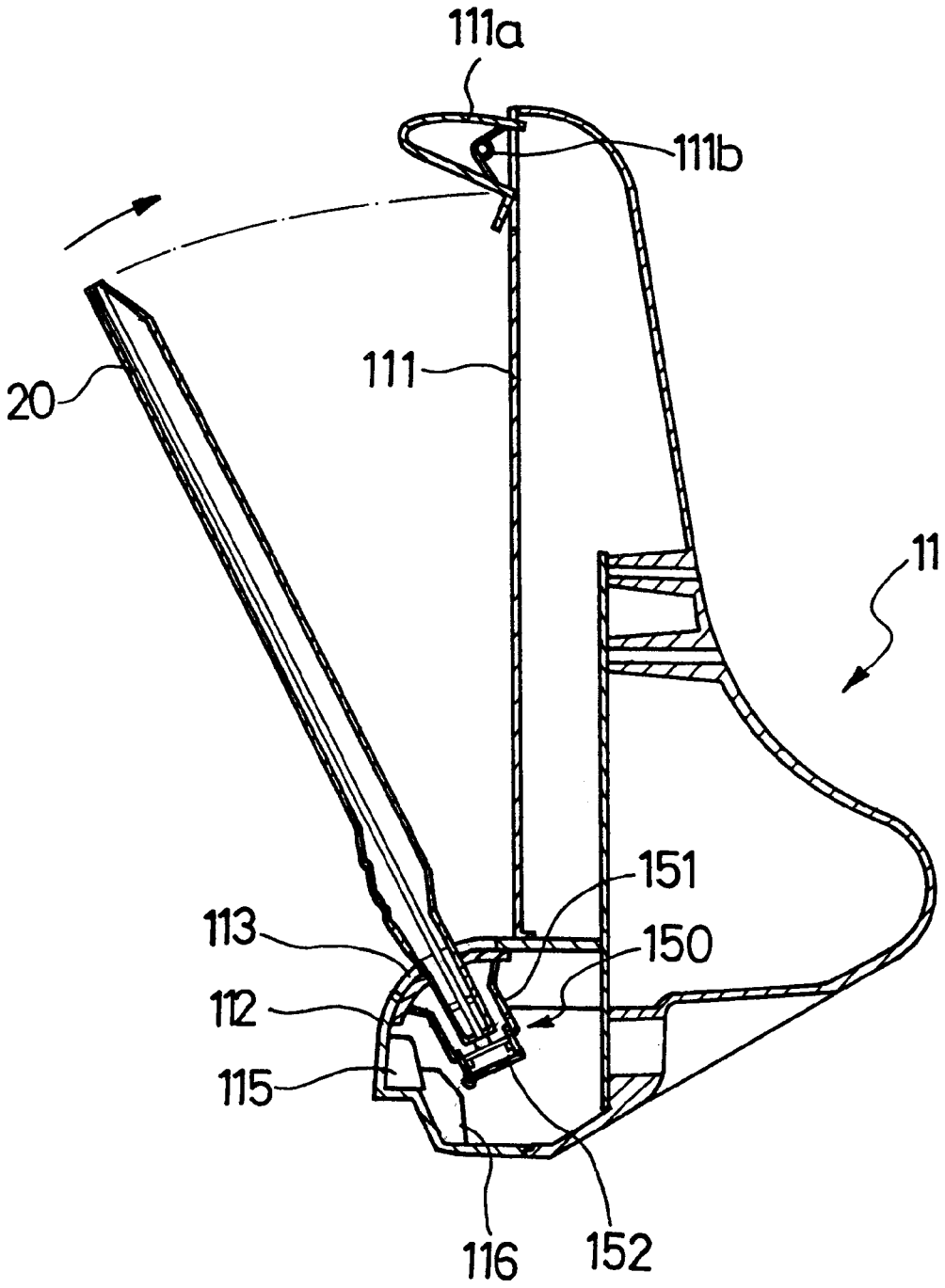
FIG. 2 is a sectional view illustrating inserted condition of a cartridge into a subsidiary frame according to a preferred embodiment of the present invention.

Moreover, as shown in FIG. 2, supporting frame 111 for supporting cartridge 20 by contacting the rear face of cartridge 20 with the front face of upper case 11 and subsidiary frame 112 protruding to a vertical direction to supporting frame 111 is formed at the lower portion of upper case 11. A cartridge inserting groove, or slot 113 for inserting or withdrawing the cartridge 20 is formed at the upper portion of subsidiary frame, or device 112 and door 114 is openably formed at the lower side of cartridge inserting groove 113.

In the subsidiary frame, or housing 112, a cartridge connecting means 150 is formed at the inner side of the cartridge inserting groove 113.

The width of the cartridge inserting groove 113 is about a size that the cartridge 20 can rotate to a predetermined angle.

The cartridge connecting means 150 includes cartridge holder, or sleeve coupling 151 having an opening 151*a* for inserting or withdrawing the cartridge 20 at the top face of the cartridge connecting means 150 and a connector supporting holder, or shaft 152 equipping with a connector printed circuit board 16 and a connector 17 in the inner portion of the cartridge connecting means 150.

A stopper hooking protrusion 115 for regulating a rotating range of the cartridge holder 151 is formed at the inner side of the subsidiary frame 112. A guide rib 116, which guides sliding of a connector supporting holder 152, is formed at the lower side of the subsidiary frame 112. And, one side portion of the connector supporting holder 152 equips with a rib contacting roller 153, which slides on the top face of the guide rib 116.

Figure 6:
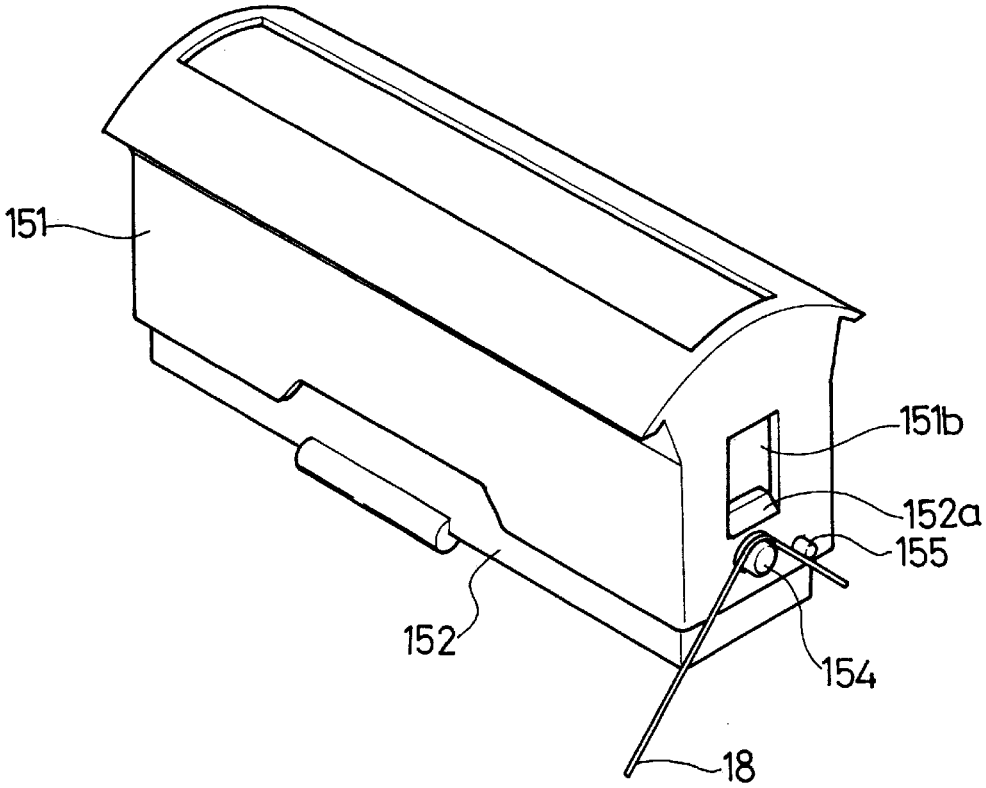
FIG. 6 is a perspective view illustrating a connector supporting holder according to the present invention.
Figure 7:
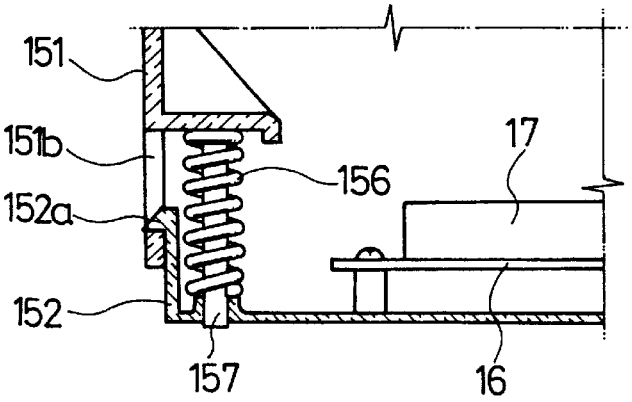
FIG. 7 is a partially sectional view of FIG. 6.

A torsion spring 18 for always positioning the cartridge holder 151 to the front direction before inserting the cartridge 20 into the cartridge inserting groove 113 is fixed to a rotating shaft 154 formed at the side of the cartridge holder 151. 14 Moreover, as shown in FIGS. 6 and 7, one end portion of the torsion spring 18 is fixed to the inner side of the subsidiary frame 112 and another end portion is regulated by a stopper 155 formed at the side of the cartridge holder 151.

A coil spring 156, which is installed on both sides of a guide shaft 157 in the connector supporting holder 152, supports the connector supporting holder 152 elastically to move to a downward direction of the cartridge holder 151.

Because hooking protrusion, or latch 152*a* is formed on both upper end portions of the connector supporting holder 152 and a hooking groove, or channel 151*b* is formed on both sides of the cartridge holder 151, the hooking protrusion 152*a* of the connecting supporting holder 152 is engaged with by the hooking groove 151 *b*of the cartridge holder. Consequently, the connector supporting holder 152 is not separated from the cartridge holder 151.

In the mean time, a locking knob, or clip, 111*a* for engaging combining the upper end portion of the cartridge 20 and a torsion spring 111*b* for elastically supporting the locking knob 111*a* is installed on the upper end portion of the supporting frame 11.

The operation of the present invention having above-mentioned structure will be described hereinafter.

Figure 3:
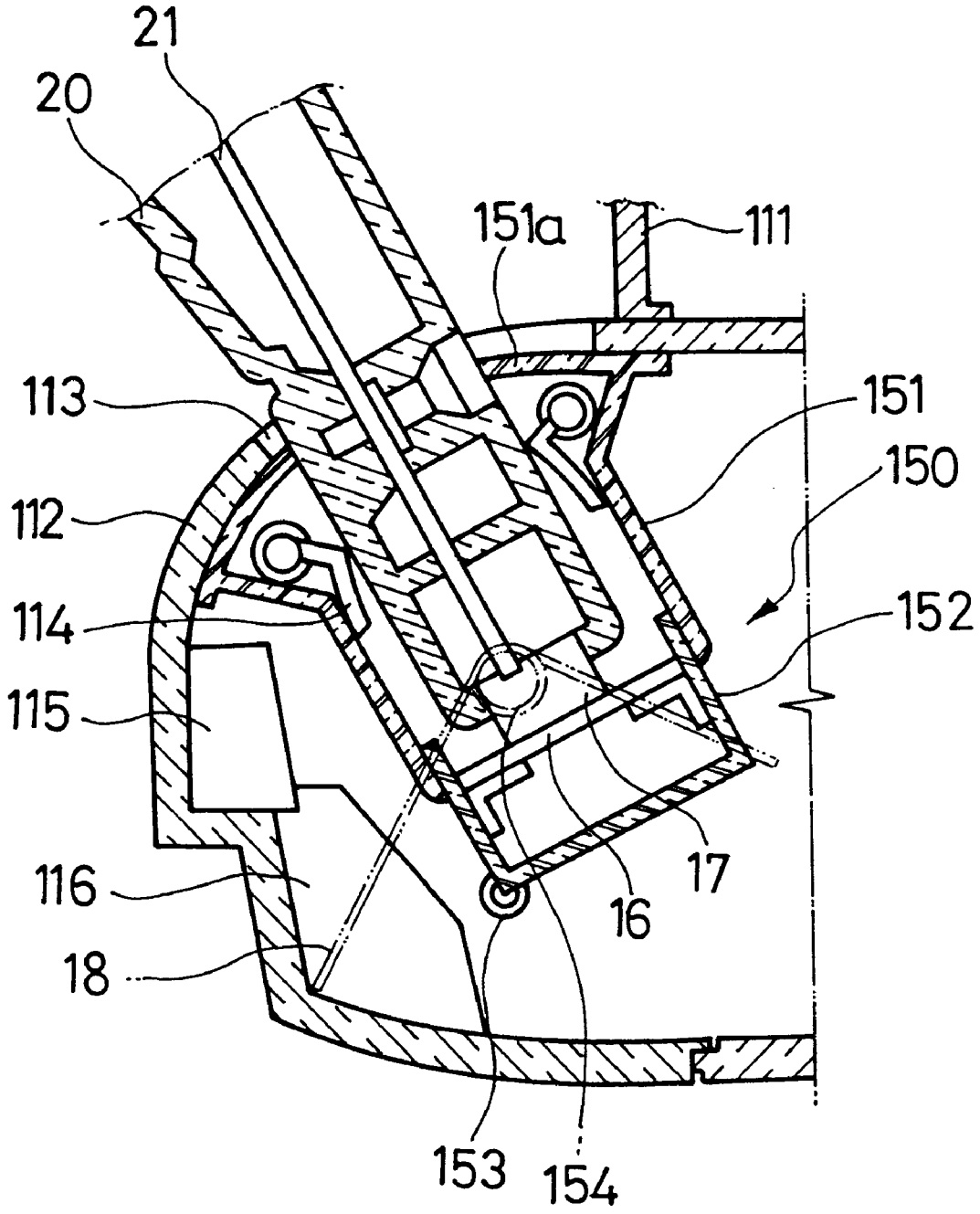
FIG. 3 is an enlarged view illustrating an important part of FIG. 2.

As shown in FIGS. 2 and 3, in the inserting operation of the cartridge, when the cartridge 20 is inserted into the cartridge inserting groove 113, the door 114 is opened and the cartridge 20 is inserted into the cartridge holder 151. But, in this condition, the printed circuit board 21 of the cartridge 20 is not fully connected to the connector 17.

Figure 4:
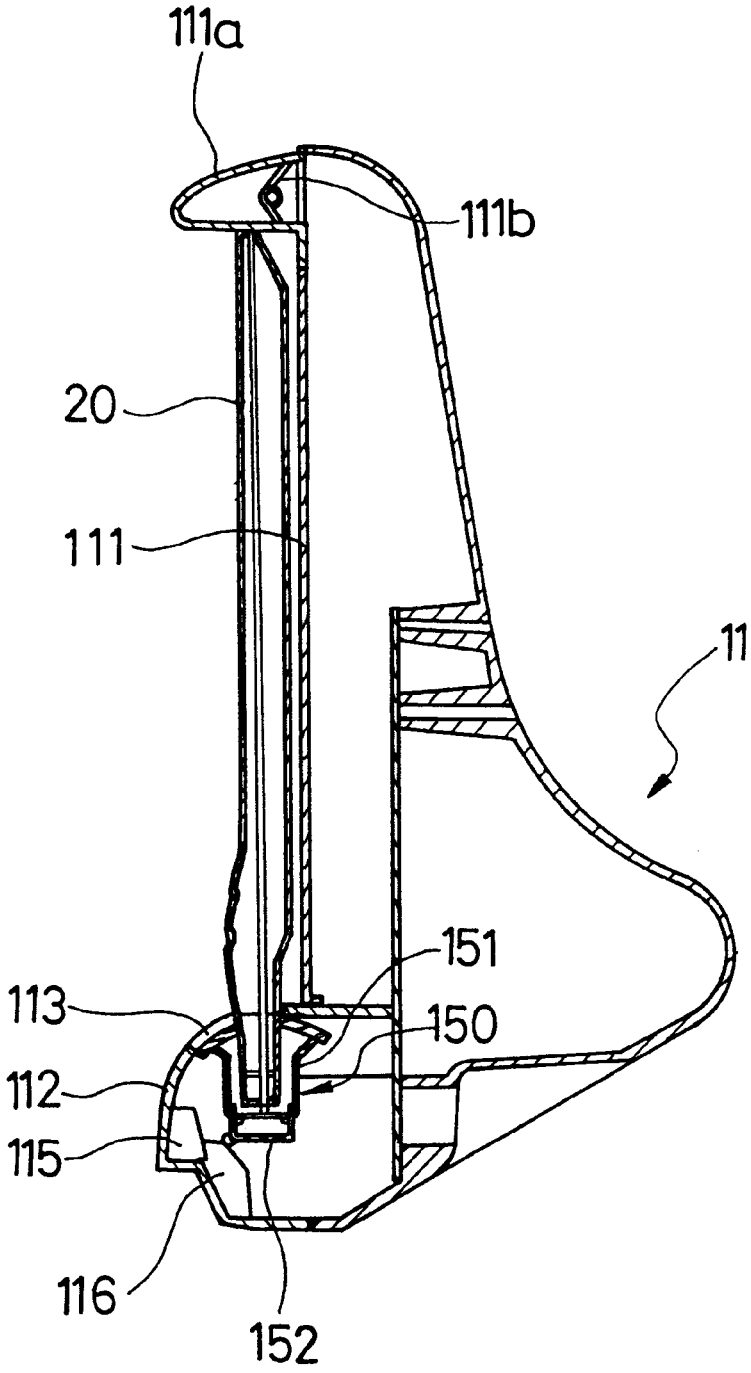
FIG. 4 is a side view illustrating connected condition of a cartridge to a connector according to a preferred embodiment of the present invention.
Figure 5:
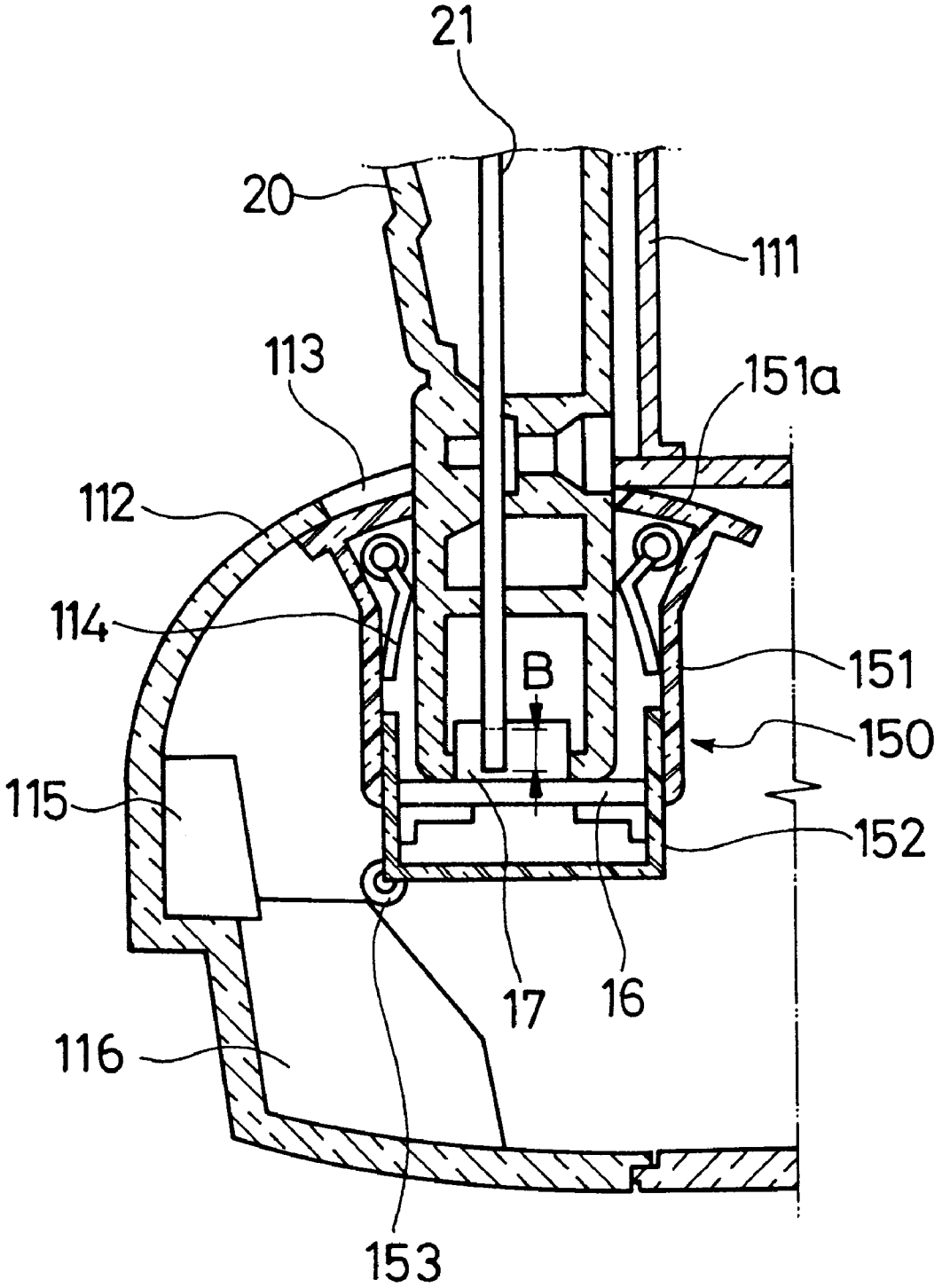
FIG. 5 is an enlarged view illustrating an important part of FIG. 4.

When the cartridge 20 is closely sticking to the supporting frame 111 by rotating the cartridge 20 to the supporting frame 111 of the upper case 11 as shown in FIGS. 4 and 5, the upper end portion of the cartridge 20 pushes the locking knob 111*a* and is received. Simultaneously, the connecting holder 152, which is interlocked with rotating cartridge 20 and attached to the lower portion of the cartridge holder 151, moves upward in the cartridge holder 151 when the rib contacting roller 153 slides along the top face of the guide rib 116. Then, the coil spring 156 installed on both sides of the inner portion of the connector supporting holder 152 is compressed.

When the connector supporting holder 152 moves upward in the cartridge holder 151, the printed circuit board 21 of the cartridge 20 connects to the connector 17 automatically. Accordingly, an electric signal is transported to the connector printed circuit board 16.

Figure 8:
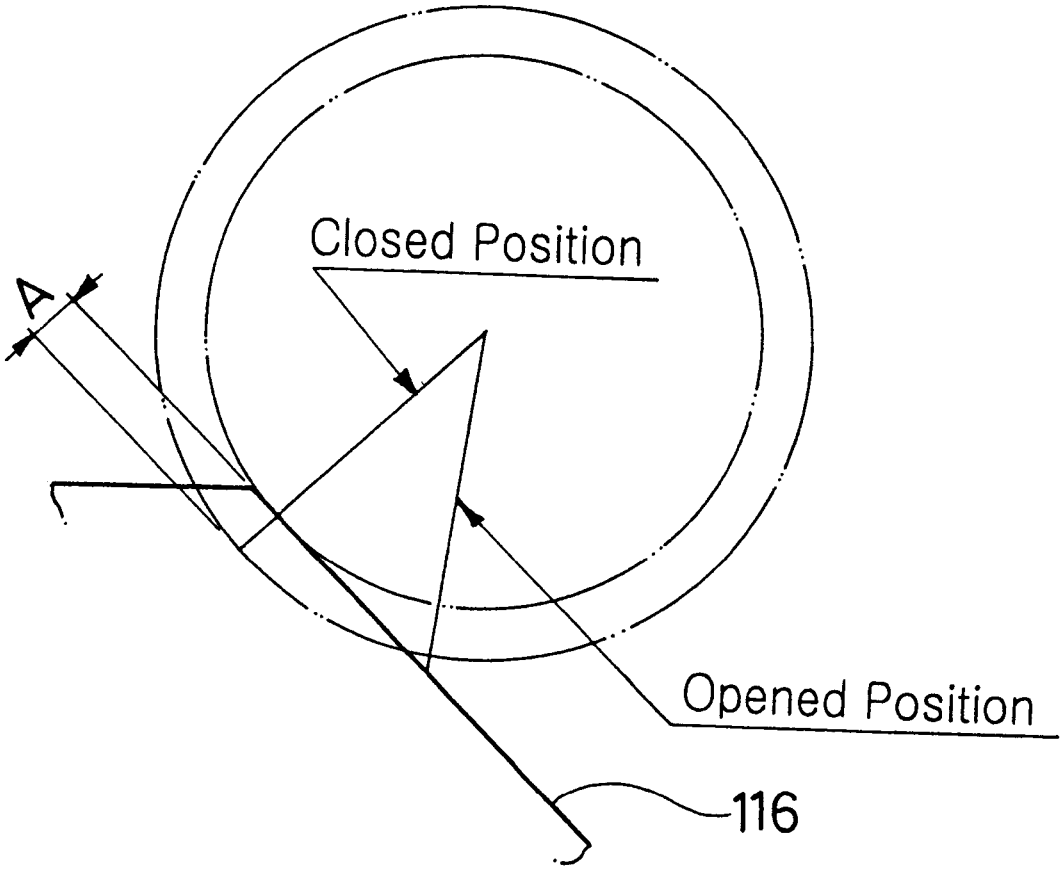
FIG. 8 is a diagram showing locus of a lib contacting roller according to the present invention.

At this time, the ascending length A of the connector supporting holder 152 as shown in FIG. 8, wherein the ascending length A is the length from the condition before the cartridge 20 is received in the supporting frame 111 to the condition that the cartridge 20 is received in the supporting frame 111, is the same to the connecting length B for connecting the printed circuit board 21 of the cartridge 20 to the connector 17 as shown in FIG. 5. Consequently, the connection is exactly executed.

When the user withdraws or changes the cartridge 20 after finishing to use the learning device, the user turns down the cartridge 20 to the inserting position after the upper end portion of the cartridge 20 is separated from the locking knob 111*a* of the supporting frame 111. The connector supporting holder 152 is moved to the lower side of the cartridge holder 151 by the elastic power of the coil spring 156, wherein the coil spring 156 supports the connector supporting holder 152 elastically to the downward direction in the connector supporting holder 152. Accordingly, the printed circuit board 21 of the cartridge 20 automatically separates from the connector 16 and the connecting condition is released.

In this released condition, the user can easily withdraw the cartridge 20 from the cartridge inserting groove 113.

When the user only rotates the cartridge toward the supporting frame direction in such a condition that the cartridge is inserted, the connector supporting holder having the connector moves to the upper direction. Accordingly, the printed circuit board of the cartridge connects to the connector exactly. Consequently, the connecting failure between the cartridge and the connector can be prevented.

Moreover, because the inserting and withdrawing operation of the cartridge are executed before and behind the connecting operation of the connector, the inserting and withdrawing operation of the cartridge are easily executed.

As the terms mentioned in the specification are determined based upon the function of the present invention, and they can be changed according to the technician's intention or a usual practice, the terms should be determined considering the overall contents of the specification of the present invention.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A connecting apparatus for connecting a cartridge enclosing a printed circuit board to a main body of a learning device, comprising:

a supporting frame installed on the main body of said learning device for supporting a rear face of said cartridge;

a subsidiary frame installed on a lower side of said supporting frame, said subsidiary frame having an inserting groove formed on an upper portion for inserting the cartridge;

a cartridge holder that holds the cartridge in said subsidiary frame; and a connector supporting holder for connecting or disconnecting a connector to or from a printed circuit board of the cartridge by ascending and descending in an inner portion of the cartridge holder as a function of the rotation of the cartridge holder, said connector supporting holder supporting said connector.

2. The connecting apparatus of claim 1, wherein a torsion spring biases said cartridge holder to rotate in a direction withdrawing the cartridge from said supporting frame.

3. The connecting apparatus of claim 2, wherein said torsion spring is fixed to an inner side of said subsidiary frame and regulated by a stopper formed at a side of said cartridge holder.

4. The connecting apparatus for cartridge of the learning device of claim 1, wherein a roller is installed on one lower portion of said connector supporting holder and a guide rib is formed in an inner portion of said subsidiary frame and said guide rib guides said roller when said cartridge rotates so that the connector supporting holder ascends in said cartridge holder further securing said connector and said printed circuit board.

5. The connecting apparatus of claim 4, wherein a coil spring is installed on a guide shaft, said coil spring biases said connector supporting holder in a downward direction of said cartridge holder.

6. The connecting apparatus of claim 1, wherein a locking knob detachably engages an upper end portion of said cartridge and a torsion spring biases the locking knob to prevent said cartridge from separating from said supporting frame.

7. A cartridge securing system, comprising:

a cartridge having a first end, a first major surface, and a second end and enclosing a printed circuit board that is accessible via an opening in said second end;

a frame having a second major surface and capable of supporting said cartridge with said first major surface abutting said second major surface;

a clip disposed proximate to a first edge of said second major surface for securing said first end of said cartridge against said frame;

a device disposed along a second edge, opposite from said first edge, of said second major surface for securing said second end of said cartridge, said device comprising:

a housing bearing a slot that receivably engages said second end of said cartridge;

a sleeve coupling extending inward from said housing and surrounding said slot;

a shaft slidably engaged with said sleeve coupling; and a connector mounted on said shaft and contained within said sleeve coupling, said connector engageable with said printed circuit board in said cartridge;

said cartridge securely engageable with said frame while said first end of said cartridge is engaged with said clip and said second end of said cartridge is engaged with said device to bring said printed circuit board into engagement with said connector.

8. The cartridge securing system of claim 7, further comprising:

an elastic member biasing said shaft in a first direction away from said slot causing said shaft to protrude from said sleeve coupling;

a roller attached to said shaft;

a rib attached along an inner surface of said housing; and said rib abutting said roller while said first major surface is being brought into contact with said second major surface, thus causing said shaft to move in a second direction, opposite from said first direction, and further securing said printed circuit board with said connector.

9. The cartridge securing system of claim 8, further comprising a second elastic member biasing said sleeve coupling to rotate said cartridge away from said frame and separate said first major surface from said second major surface.

10. The cartridge securing system of claim 9, further comprising a panel covers said slot in said housing and rotates to expose said slot when said second end of said cartridge abuts said panel.

11. The cartridge securing system of claim I0, further comprising:

a channel in said sleeve coupling; and a latch protruding from a distal end of said shaft and engaging said channel.

12. A cartridge securing system, comprising:

a cartridge having a first end, a first major surface, and a second end and enclosing a printed circuit board that is accessible via an opening in said second end;

a frame having a second major surface and capable of supporting said cartridge with said first major surface abutting said second major surface;

a clip disposed proximate to a first edge of said second major surface for securing said first end of said cartridge against said frame;

a device disposed along a second edge, opposite from said first edge, of said second major surface for securing said second end of said cartridge, said device comprising:

a housing bearing a slot that receivably engages said second end of said cartridge;

a sleeve coupling extending inward from said housing and surrounding said slot;

a shaft slidably engaged with said sleeve coupling;

a connector mounted on said shaft and contained within said sleeve coupling, said connector engageable with said printed circuit board in said cartridge;

an elastic member biasing said shaft in a first direction away from said slot causing said shaft to protrude from said sleeve coupling;

a roller attached to said shaft;

a rib attached along an inner surface of said housing; and said rib abutting said roller while said first major surface is being brought into contact with said second major surface, thus causing said shaft to move in a second direction, opposite from said first direction, and further securing said printed circuit board with said connector; and said cartridge securely engageable with said frame while said first end of said cartridge is engaged with said clip and said second end of said cartridge is engaged with said device to bring said printed circuit board into engagement with said connector.

13. The cartridge securing system of claim 12, further comprising a second elastic member biasing said sleeve coupling to rotate said cartridge away from said frame and separate said first major surface from said second major surface.

14. The cartridge securing system of claim 13, further comprising a panel covers said slot in said housing and rotates to expose said slot when said second end of said cartridge abuts said panel.

15. The cartridge securing system of claim 14, further comprising:

a channel in said sleeve coupling; and a latch protruding from a distal end of said shaft and engaging said channel.

* * * * *